US005189280A

United States Patent [19]

Okazaki et al.

[11] Patent Number: 5,189,280

[45] Date of Patent: Feb. 23, 1993

[54] GLOW PLUG FOR DIESEL ENGINES

[75] Inventors: Seiji Okazaki, Moka; Shigeki Yokoyama, Kumagaya; Makoto Imaizumi, Moka; Koji Hatanaka; Takashi Aota, both of Higashimatsuyama, all of Japan

[73] Assignees: Hitachi Metals, Ltd.; Jidoshakiki Co. Ltd., both of Tokyo, Japan

[21] Appl. No.: 642,703

[22] Filed: Jan. 16, 1991

Related U.S. Application Data

[63] Continuation of Ser. No. 266,565, Nov. 3, 1988, abandoned.

[30] Foreign Application Priority Data

Nov. 5, 1987 [JP] Japan ..... 62-280152
Dec. 10, 1987 [JP] Japan ..... 62-188171
Sep. 29, 1988 [JP] Japan ..... 63-245570

[51] Int. Cl.[5] ..... F23Q 7/22; F02P 19/02; H05B 3/00

[52] U.S. Cl. ..... 219/270; 123/145 R; 219/85.2; 219/553

[58] Field of Search ..... 219/205, 270, 553, 85.2; 123/145 A, 145 R

[56] References Cited

U.S. PATENT DOCUMENTS 4,475,029 10/1984 Yoshida et al. ..... 219/270
4,499,366 2/1985 Yoshida et al. ..... 219/270
4,606,978 8/1986 Mizuhara ..... 219/85.2
4,606,981 8/1986 Mizuhara ..... 219/85.2
4,806,734 2/1989 Masaka et al. ..... 219/270
4,810,853 3/1989 Maruta et al. ..... 219/270
4,814,581 3/1989 Nunogaki et al. ..... 219/270
4,874,923 10/1989 Hatanaka et al. ..... 219/553
4,914,571 4/1990 Masaka et al. ..... 219/553
4,931,619 6/1990 Ogata et al. ..... 219/270

FOREIGN PATENT DOCUMENTS 114630 6/1985 Japan ..... 219/270
61-29619 2/1986 Japan ..... 219/270
126690 5/1988 Japan ..... 219/85.2

*Primary Examiner*—Geoffrey S. Evans
*Attorney, Agent, or Firm*—McGlew & Tuttle

[57] ABSTRACT

A glow plug for diesel engines in which a ceramic heater is supported, with the one end thereof cantilevered toward the outside, by the tip of a hollow holder ceramic heater is composed of a U-shaped heating portion and a pair of leads extending backwards from both ends of the U-shaped heating portion, both being formed integrally by an electrically conductive ceramic material. The outer periphery of at least one of the leads is bonded and held in the holder via an insulating layer. The rear end of the other of the leads is connected by a metallic lead wire to an external connection terminal. The ceramic heater and other component members are bonded integrally by a bonding material containing a reactive metal.

18 Claims, 4 Drawing Sheets

GLOW PLUG FOR DIESEL ENGINES

This is a file wrapper continuation application of application Ser. No. 07/266,565 filed Nov. 3, 1988, now abandoned.

BACKGROUND OF THE INVENTION

1. Field of the Invention

This invention relates generally to a glow plug to be used for preheating an auxiliary combustion chamber or combustion chamber in a diesel engine, and more particularly to a glow plug for diesel engines comprising a ceramic heater that permits after glowing for long hours.

2. Description of Prior Art

In general, a diesel engine has poor starting properties at low temperatures. To assist the diesel engine in starting, therefore, a glow plug is usually provided in an auxiliary combustion chamber or combustion chamber to raise the intake air temperature or for use as an ignition source, the heat being generated by applying electricity to the plug. The glow plug is usually of a sheathed heater type constructed by filling a metallic sheath with heat-resistant insulating powder and embedding a heater coil, made of ferrochrome, nickel, etc., in the powder. In addition to this, a ceramic heater type is also known, as disclosed in Japanese Pat. Laid-open No. 41523/1982, which comprises a heating wire, made of tungsten, etc., which is embedded in an insulating ceramic material, such as silicon nitride. The ceramic heater type has been widely used in recent years because it has a better heat transfer efficiency and an excellent heat generating performance since it becomes red hot in a short period of time during heating, compared with the sheathed heater type which involves indirect heating by means of the heat-resistant insulating powder and the sheath.

The glow plug of the ceramic heater type, however, has a metallic heating wire, made of tungsten, etc., embedded in the inside of an insulating ceramic material, such as silicon nitride. The different coefficients of thermal expansion of both the members, the sharp temperature rise during heating and the repeated use of the heater tends, to deteriorate the durability of the ceramic heater and cause problems in the reliability, including heat resistance, of the ceramic heater. This also results in increased manufacturing costs.

To solve this problem, a ceramic heater construction which employs as a heating wire an electrically conductive ceramic material having a coefficient of thermal expansion substantially equal to that of an insulating ceramic material has been proposed in Japanese Pat. Laid-open Nos. 9085/1985 and 14784/1985. However, both the proposed glow plugs still have problems in terms of both construction and function, and therefore have not been put into commercial application.

For example, the former, having a construction that an electrically conductive ceramic material as a heating element is embedded into an insulating ceramic material, has better thermal conductivity than the sheathed type, but it involves a number of problems such as a poor quick-heating function because of the indirect heating type and the difficulty in molding.

The latter, on the other hand, has a quick-heating function due to its heating element exposed to the surface of the heater, but the fact that its heating element is a laminated structure of U-shaped members, with both ends being led to the rear end of the heater, makes the electrode take-off construction complex, leading to increased manufacturing costs.

To overcome these problems, the present applicant of this invention invented, filed and disclosed as the Japanese patent application No. 9933 of 1986 a glow plug for diesel engines in which a rod-shaped ceramic heater supported by the tip of a holder is composed of a U-shaped heating portion and a pair of lead wires extending backwards from the both ends of the U-shaped heating portion; both being formed integrally by an electrically conductive ceramic material; the outside surface of one lead wire being held via an electrically conductive layer, and the other lead wire held by joining to the holder via an insulating layer.

This previous invention, in which a heating portion is formed solely by an electrically conductive ceramic material containing no foreign matter, has high reliability in terms of heat resistance, and is excellent in durability such as heating characteristics, despite the repeated thermal stresses applied during use. The previous invention is also beneficial in moldability, contributing to a reduction in manufacturing costs. In addition, the previous invention has a quick-heating function as the heater tip can be quickly red-heated by the heating portion comprising an electrically conductive ceramic material exposed to the heater surface.

In a glow plug having the aforementioned construction, the space in the holder is led to the engine combustion chamber, etc. facing the ceramic heater by a slit formed in the longitudinal direction of the ceramic heater. Consequently, it is necessary to prevent the combustion pressure developed at the time of explosion in the combustion chamber from leaking to the outside. To this end, the ceramic heater of the previous invention employs a closing member made of a ceramic material, such as alumina or mullite, as a means for closing the gap or slit formed between the components of the ceramic heater. That is, a closing member made of a ceramic material, such as alumina or mullite, is inserted into the silt and integrally bonded together using glass paste as an adhesive. With this bonding means, however, pores may be caused due to the use of glass paste. This could result in imperfect air-tightness around the bonded portion, causing carbon, oil, fuel, etc. to infiltrate into the space inside the holder, posing problems, such as corrosion of internal metallic lead wires and shortcircuiting in extreme cases. The use of glass paste of a high viscosity makes automation difficult, presenting an obstacle to the improvement of productivity. In recent years, glow plugs of this type are required to have higher durability to cope with the increased operating temperature associated with the improved starting properties of diesel engines and the increased use of turbochargers. As a result, the aforementioned means for closing the slit can no longer satisfy such stringent requirements.

In the above-mentioned ceramic heater, the most commonly used electrode bonding method for electrically connecting the ceramic heater to the power source is coating the bonding surface of a glow plug with Ni powder paste, heat-treating the paste in a vacuum at 1,150° C. for 30 minutes to form a metallized layer, and brazing on the metallized layer an electrode for connection to a metallic lead wire. With this method, however, the electrode formed tends to be separated due to the low bonding strength of the metallized layer formed on the bonding surface of the glow plug. This process is low in reliability and involves long-hour heat treatment, leading to high manufacturing costs.

SUMMARY OF THE INVENTION

It is the first object of this invention to provide a glow plug for diesel engines that can more quickly and positively accomplish the red heating of the tip thereof, compared with the conventional type of glow plug, thus functioning as a quick-heating type glow plug.

It is the second object of this invention to provide a glow plug for diesel engines that does not cause cracking and other unwanted accidents even when rapidly heating the ceramic heater, thus maintaining reliability, such as heat resistance.

It is the third object of this invention to enable an engine equipped with this glow plug to maintain afterglowing for long hours as a means for coping with exhaust gas and noise problems.

It is the fourth object of this invention to provide a glow plug for diesel engines that can perfectly bond the ceramic heater to other component members to ensure high air-tightness and/or reliability.

DETAILED DESCRIPTION OF PREFERRED EMBODIMENTS

Figure 1:
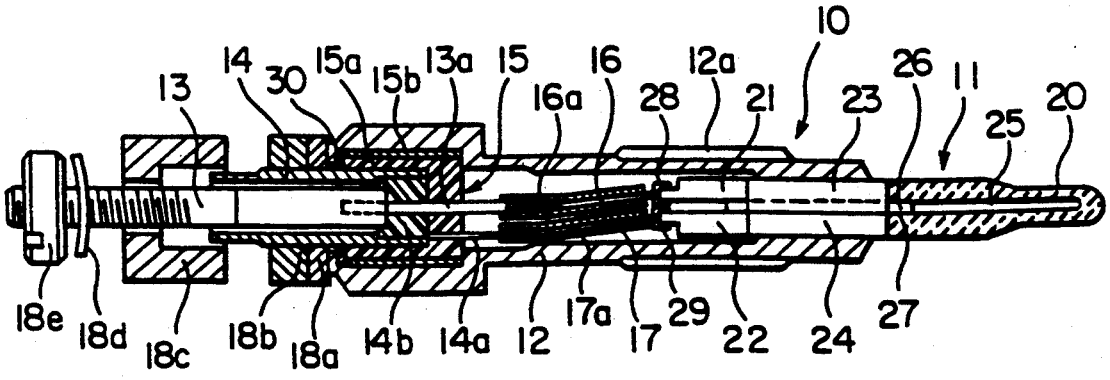
FIG. 1 is a longitudinal section of an embodiment of this invention.

FIG. 1 is a longitudinal section showing an embodiment of this invention. The construction of a glow plug which is referred to as numeral 10 in the figure will be outlined in the following. The glow plug 10 has a rod-shaped ceramic heater 11, the tip of which serves as a heating element, and a substantially tubular metallic holder 12, made of stainless steel, for example, which holds the ceramic heater 11 at the tip thereof. A threaded part 12*a* is formed on the outer periphery of the holder 12, and screwed into a threaded hole (not shown) provided on the cylinder head of the engine to support the tip of the ceramic heater 11 in a cantilevered state into a combustion chamber or auxiliary combustion chamber. At the rear end of the holder 12, fitted and supported is a terminal assembly 15 consisting of first and second external connection terminals 13 and 14, which are passed and embedded into a terminal assembly 15, made of a synthetic resin or an appropriate other insulating material. The external connection terminals 13 and 14 are connected to leads 21 and 22 comprising the ceramic heater 11 via metallic lead wires 16 and 17, such as flexible wires, and terminal caps 28 and 29.

Next, the terminal assembly 15 has a first external connection terminal 13 having at the inner end thereof a rod portion 13*a* disposed along the axis line of the terminal assembly 15 via an insulating member 14*b* and connected to the metallic lead wire 16, and a second tubular external connection terminal 14 having a lead piece 14*a* disposed at a predetermined gap around thereof and connected to the metallic lead wire 17, and an assembly body 15*a* integrally formed with a resin in such a manner as to insulate both the terminals 13 and 14 and the outer periphery of the terminal 14. A metallic tube 15*b* for reinforcing the connecting portion is fitted on the outer periphery of the assembly body 15*a*. The metallic tube 15*b* is crimped by exerting a high pressure to the edge of the open rear end of the holder 12 until the metallic tube 15*b* is buckled along the axial line so that the inside of the metallic tube 15*b* is forced onto the side of the assembly body 15*a* made of a resin and the outside thereof onto the inside surface of the holder 12, thereby eliminating the effects of external force or thermal shrinkage.

Next, 18*a* and 18*b* refer to an insulating ring and a washer, respectively, both being fitted to the second external connection terminal 14 protruding toward the rear of the holder 12. 18*c* refers to an insulating member to be fitted to the side of the first external connection terminal 13 immediately adjacent to the outside end of the washer 18*b*. 18*d* and 18*e* refer to a spring washer and a fixing nut, respectively, to be fitted and screwed to the threaded part formed on the outside end of the first external connection terminal 13. The first and second external connection terminals 13 and 14 are electrically connected to the battery by interposing lead wires (not shown) drawing from the battery between the washer 18*b* and the insulating member 18*c* and between the insulating member 18*c* and the spring washer 18*d*. 16*a* and 17*a* refer to insulating members, such as tubes, for covering the metallic lead wires 16 and 17.

The ceramic heater 11 can be formed by mixing electrically conductive sialon powder, for example, with thermoplastic resin, etc., injection molding the mixture into a metal mold having a predetermined cavity and baking the molding, or by machining a rod-shaped blank into a predetermined shape by electrical discharge machining or cutting. A heating portion 20 of the heater 11 is formed in a smaller diameter than that of the leads 21 and 22 so that the thickness of the heating portion 20 becomes smaller than the thickness of the leads 21 and 22. A slit 25 is formed at the middle part of the ceramic heater 11 from the heating portion 20 towards the leads 21 and 22. An insulating sheet 26 formed by an insulating ceramic material, such as mullite, is inserted into the leads 21 and 22 forming the slit 25 at least at a location corresponding to the tip of the holder 12. That is, a metal brazing material 27 (including a reactive metal such as Ti, Zr or Hf) is inserted or applied between the leads 21 and 22, and the insulating sheet 26, and heated in a vacuum or inert gas to melt the metallic brazing material 27 to form reaction layers, which will be described later, on the leads 21 and 22, and the insulating sheet 26 to integrally bond them together.

As a ceramic material for this invention, beta-type sialon or alpha-type sialon may be used. When beta-type sialon is used, the Z value in $Si_{6-z}Al_zO_zN_{8-z}$ should be more than 0 and less than 1. When alpha-type sialon is used, on the other hand, M in the composition of $M_x(SiAl)_{12}(ON)_{16}$ should preferably consist of Y or Ca, and X should be more than 0 and less than 2.0. A part or the whole of Y or Ca mentioned above may be replaced with Mg. With the abovementioned range of composition, a sintered material of a high strength can be obtained.

Next, to obtain an electrically conductive ceramic material, a nitride or carbide nitride solid solution of Ti is added as an electrical conductivity imparting material for the following reason.

Although the use of any of carbides, nitrides or borides of the IVa, Va, or VIa column can produce an electrically conductive sintered sialon, carbides and nitrides of Ti are most suitable when considering sintering properties in the normal- or gas-pressure sintering process and the anti-oxidation properties of the sintered product. Furthermore, the use of a carbide-nitride solid solution, rather than an individual carbide or nitride, could offer a more beneficial effect that the electrical resistivity of sintered sialon can be changed by changing the ratio of C and N in the solid solution.

Numeral 30 refers to a sealing sheet, made of rubber, or asbestos, etc., which is placed on the outside end of the terminal assembly 15 having first and second external connection terminals 13 and 14 at the open rear end of the holder 12 to mechanically seal that portion.

Next, the bonding method of the ceramic heater 11 and the holder 12 will be described. The most commonly used material for bonding both is silver solder. Insulating layers 23 and 24 made of an insulating material, such as glass, are provided on the outer periphery of the leads 21 and 22 of the ceramic heater 11. To improve the wetting properties with silver solder, an Ag-Pd paste is applied on the outer periphery of the insulating layers 23 and 24, and baked at 750°–850° C. to form a metallized layer of thickness 5–20 μm. Then, the holder 12 and the ceramic heater 11 are bonded together using silver solder to obtain a glow plug shown in FIG. 1.

Figure 2:
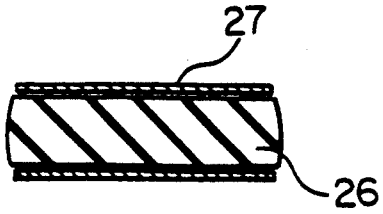
FIG. 2 is an enlarged cross-section illustrating an insulating sheet and a metallic brazing material before bonding.
Figure 3:
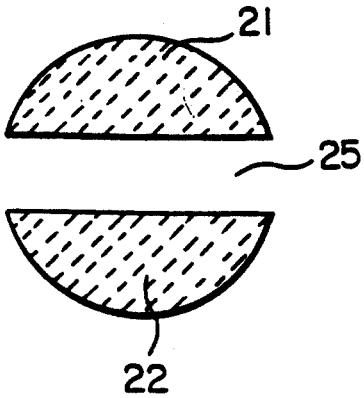
FIG. 3 is an enlarged cross-section of a lead before bonding.
Figure 4:
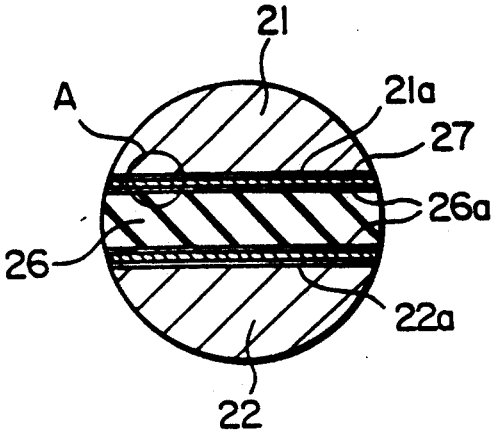
FIG. 4 is an enlarged cross-section illustrating a lead after bonding.

Next, the bonding method of the leads 21 and 22, and the insulating sheet 26 will be described referring to FIGS. 2 through 4. FIG. 2 is an enlarged cross-section of the insulating sheet 26 and the metallic brazing material 27 before bonding. FIG. 3 is an enlarged cross-section of the leads 21 and 22 before bonding. FIG. 4 is an enlarged cross-section of the leads 21 and 22 after bonding.

As shown in FIG. 2, the metallic brazing material 27 comprising a 60-μm thick 16%Ti-Cu alloy foil formed into substantially the same width and length as those of the insulating sheet 26 is deposited on the upper and lower surfaces of the insulating sheet 26. Then, the insulating sheet 26 and the metallic brazing material 27 formed into a shape shown in FIG. 2 are inserted into the slit 25 between the leads 21 and 22 shown in FIG. 3. The entire assembly is then heat-treated in a vacuum of $2\times10^{-5}$ Torr at 1,130° C. for 30 minutes. With this heat treatment, the metallic brazing material 27 is melted to form approx. 20-μm thick reaction layers **21*a*, 22*a* and 26*a* on the bonded surfaces of the leads 21 and 22, and the insulating sheet 26, thus completing an integral bonding, as shown in FIG. 4. With this arrangement, the slit 25 between the leads 21 and 22 is closed and sealed with the tip of the holder 12 shown in FIG. 1**, thus sealing and preventing the combustion pressure of the engine from leaking to the outside.

Figure 5:
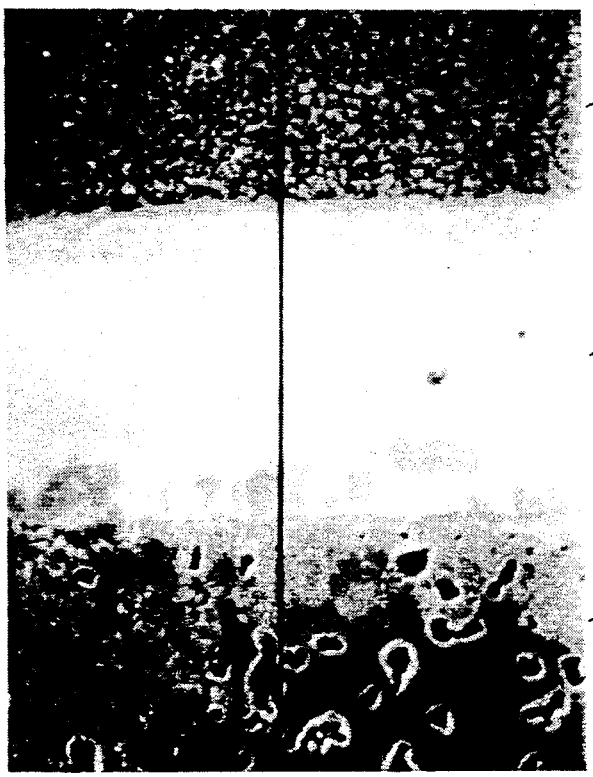
FIG. 5 is a microphotograph illustrating the microstructure of portion A in FIG. 4.

FIG. 5 is a microphotograph illustrating the metallic structure of portion A in FIG. 4. In FIG. 5, it is found that the reaction layers **21*a* and 26*a* are each formed between the metallic brazing material 27 and the lead 21, and between the metallic brazing material 27 and the insulating sheet 26. The analysis results of the reaction layers 21*a* and 26*a* with a scanning type analytical electron microscope reveal that the reaction layers 21*a* and 26*a* are intermediate layers of the titanium contained in the metallic brazing material 27, the electrically conductive sialon, for example, constituting the lead 21, and the mullite constituting the insulating sheet 26. That is, intermediate layers are formed as the titanium in the metallic brazing material 27 is selectively adsorbed in the interfaces between the metallic brazing material 27 and the lead 21, and between the metallic brazing material 27 and the insulating sheet 26. On the side of the lead 22, the reactive layer 22*a* formed is exactly the same as that on the lead 21**.

Figure 6:
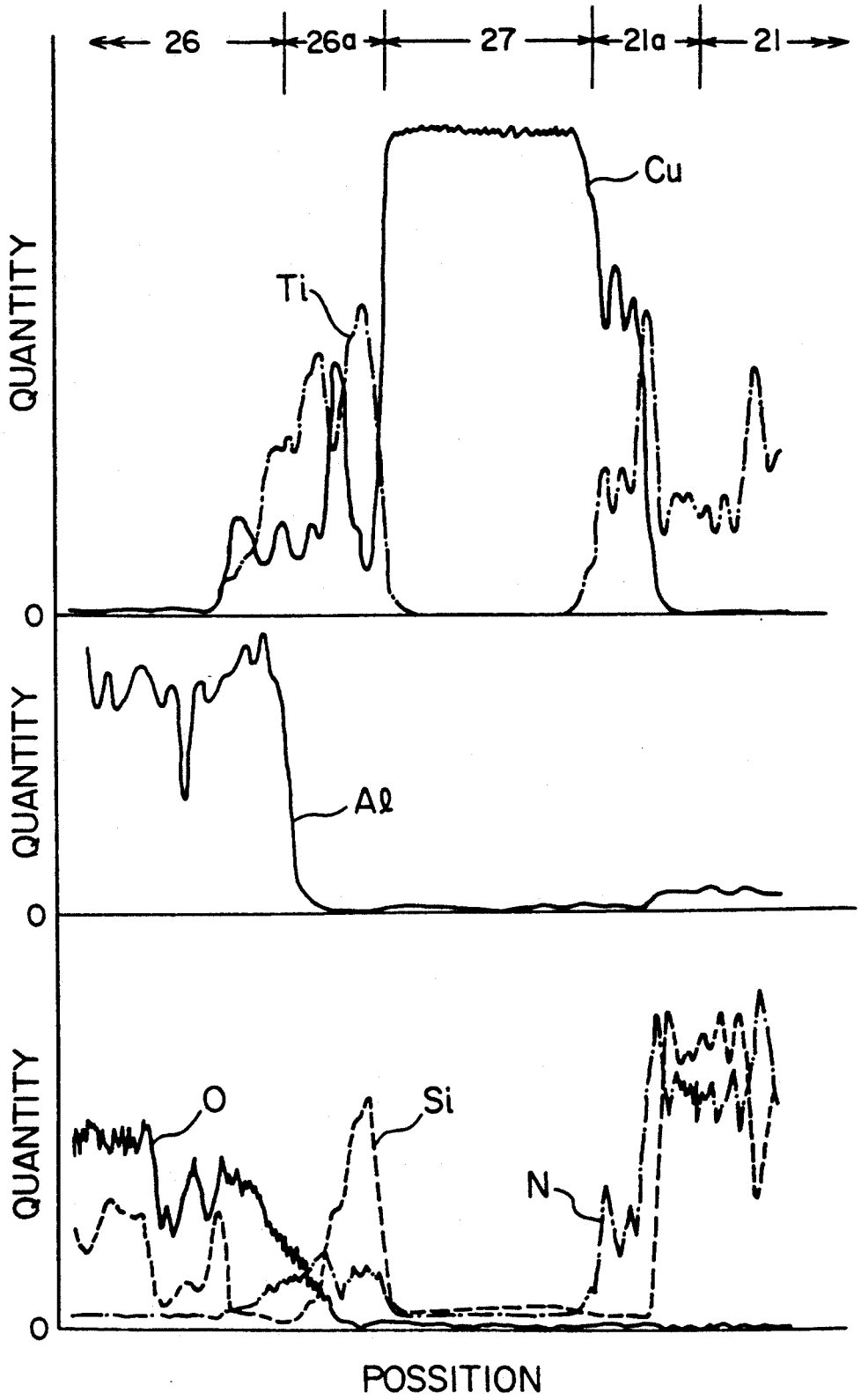
FIG. 6 is a diagram illustrating the quantities of elements at each portion in FIG. 5 scanned in the direction shown by an arrow with a scanning type analytical electron microscope.

FIG. 6 is a diagram illustrating the analysis results by the scanning type analytical electron microscope. In FIG. 6, an element group consisting of titanium and copper; aluminum; and another element group of silicon, oxygen and nitrogen are shown separately. As is evident from FIG. 6, the reaction layers **21*a* and 26*a* is abundant in titanium while the metallic brazing material 27 is deficient in titanium. This means that the reaction layers 21*a* and 26*a* are formed as the titanium in the metallic brazing material 27 is selectively diffused over the interfaces of the lead 21 and the insulating sheet 26. As a result, the metallic brazing material 27 is deficient in titanium and rich in copper. The lead 21 consists of electrically conductive sialon, while the insulating sheet 26** consists of $3Al_2O_3SiO_2$, that is, mullite.

Next, bond properties and air-tightness were evaluated by changing the materials and thickness of the metallic brazing material. Table 1 shows the evaluation results of bond properties and air-tightness with changes in the materials and thickness of the metallic brazing material. In the test, bond properties and air-tightness were evaluated in the following manner. To evaluate bond properties, after the leads 21 and 22 were bonded to the insulating sheet 26, as shown in FIG. 4, the bond was separated apart, and the ratio (%) of the area left unseparated was measured. To evaluate air-tightness, the outer periphery of the bonded assembly of the leads 21 and 22, and the insulating sheet 26 was inserted in a test jig via an O ring, and an air pressure of 15 kgf/cm$^2$ was applied from one end of the bonded assembly, which was immersed in water, to measure the amount of air leaking out at the joints between the leads 21 and 22, and the insulating sheet 26. The overall evaluation results determined in accordance with the evaluation criteria shown in Table 2 are also shown in Table 1. As for No. 5 brazing material in the table, glass paste was used in place of the metallic brazing material for the purpose of comparison. The heat treatment carried out on Nos. 2 to 4 materials was the same as that used in the metallic brazing material consisting of 16%Ti-Cu alloy foil mentioned above (No. 1).

TABLE 1

| No. | Composition and thickness | Evaluation results: Bond properties | Evaluation results: Air-tightness | Overall evaluation |
|---|---|---|---|---|
| 1 | 16% Ti—Cu alloy foil (60-μm thick) | ○ | ○ | ⊙ |

TABLE 1-continued

| No. | Composition and thickness | Evaluation results: Bond properties | Air-tightness | Overall evaluation |
|---|---|---|---|---|
| 2 | 5% Ti—Cu alloy foil (48-μm thick) + Ti foil (12-μm thick) | ○ | ○ | ◎ |
| 3 | Cu foil (100-μm thick)) + Ti foil (24-μm thick) | ○ | ○ | ◎ |
| 4 | Ni foil (20-μm thick) + Ti foil (70-μm thick) | ○ | ○ | ◎ |
| 5 | Glass paste | ○ | Δ | Δ |

TABLE 2

| | ○ | Δ | X |
|---|---|---|---|
| Bond properties | Over 90% | 89~60% | Less than 60% |
| Air-tightness | Less than 5 cc/min | 5~20 cc/min | More than 20 cc/min |

Table 1 confirmed that the glass paste of No. 5 is good in bond properties, but has a problem in air-tightness. With Nos. 1–4 materials, on the other hand, the reaction layers 21*a*, 22*a* and 26*a* of the thickness approx. 20 μm formed between the metallic brazing material 27 and the leads 21 and 22, and the insulating sheet 26, as shown in FIG. 4 and 5 above, is excellent in bond properties and air-tightness.

Next, as means for forming the reaction layers 21*a*, 22*a* and 26*a* between the leads 21 and 22, and the insulating sheet 26, powder pastes shown in Table 3 were used in place of the metallic brazing materials in the above embodiment, and the same evaluation test as with the above embodiment was conducted on the bonded assemblies.

TABLE 3

| No. | Composition | Evaluation results: Bond properties | Air-tightness | Overall evaluation |
|---|---|---|---|---|
| 6 | 10% Ti—Cu mixed powder paste | Δ | ○ | ○ |
| 7 | 10% Ti—Cu alloy powder paste | ○ | ○ | ◎ |
| 8 | 3% Ti—(72% Ag—Cu alloy) mixed powder paste | ○ | ○ | ◎ |

No. 6 paste in Table 3 was obtained by uniformly mixing 10 parts by weight of Ti powder (purity: 99.5%) of under 350-mesh with 90 parts by weight of Cu powder (purity: 99.5%) of under 350-mesh, and adding to the mixture a binder consisting of 10% ethyl cellulose + 90% diethylene glycol monoethyl ether. Nos. 7 and 8 pastes were obtained by uniformly mixing three parts by weight of 10% Ti-Cu alloy powder (purity: 99.5%) of under 350-mesh or Ti powder (purity: 99.5%) of under 350-mesh with 97 parts by weight of 72% Ag-Cu alloy powder (purity: 99.5%) of under 350-mesh, and adding to the mixture the same binder as with No. 6 paste above.

Next, Nos. 6–7 pastes were applied to both sides of the insulating sheet 26 by brushing or screen printing, and then dried. After that, the insulating sheet 26 coated with each paste is inserted between the leads 21 and 22, and heat-treated in a vacuum of $2\times10^{-5}$ Torr at 1,130° C. for 30 minutes. With this process, reaction layers 21*a*, 22*a* and 26*a* of approximately 20 μm thickness are formed on the joint surfaces between the leads 21 and 22, and the insulating sheet 26 to integrally bond the leads 21 and 22 to the insulating sheet 26.

As is evident from Table 3, it was confirmed that No. 6 paste has slightly lower bond properties, but its air-tightness is good. Nos. 7 and 8 pastes are excellent in both bond properties and air-tightness.

Although this embodiment uses foil and paste as the metallic brazing material, the same effects can be expected by the use of coating materials consisting of powder or fluid substances. In addition, although this embodiment employs mullite as the insulating ceramic material comprising the insulating sheet, any other insulating materials having excellent heat resistance and good bonding strength with the electrically conductive ceramic material, such as sialon, $Si_3N_4$, AlN and other nitride-based ceramics, or $Al_2O_3$ and other oxide-based ceramics, may be used. Furthermore, a sialon whose insulating properties are selected by adjusting the addition of titanium nitride or carbide-nitride solid-solution may be used, similarly to the electrically conductive ceramic material comprising the ceramic heater. By selecting such materials, the insulating sheet can be made of the same material having almost the same coefficient of thermal expansion as the leads, thus increasing bonding strength and reliability such as heat resistance.

Figure 7:
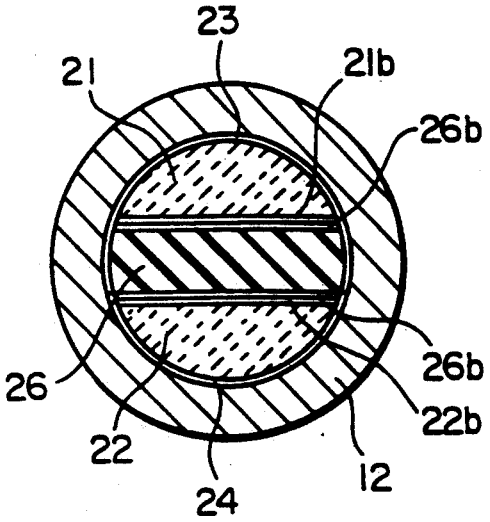
FIG. 7 is an enlarged cross-section illustrating another embodiment of this invention.

FIG. 7 is an enlarged cross-section illustrating another embodiment of this invention. Like parts are indicated by like numerals in FIGS. 1 through 4. In FIG. 7, reaction layers (not shown) consisting of a reactive metal are formed in advance on the joint surfaces of the insulating sheet 26 and the leads 21 and 22 to ensure perfect bonding of them. First, a paste is prepared by uniformly mixing three parts by weight of Ti powder (purity: 99%) of under 350-mesh with 97 parts by weight of silver solder powder (72% Ag + 28% Cu) of under 400-mesh, and adding to the mixture a binder consisting of 10% ethyl cellulose + 90% diethylene glycol monoethyl ether. The paste thus prepared is applied to the joint surfaces of the leads 21 and 22, and the insulating sheet 26 by brushing or screen printing to a thickness of 120 μm, and metallized in a vacuum of $2\times10^{-5}$ Torr at 860° C. for three minutes. With this treatment, metallized layers 21*b*, 22*b* and 26*b* of 50–60 μm thickness can be formed on the joint surfaces of the insulating sheet 26 and the leads 21 and 22. The metallized layer is surface-polished to a thickness of 40 μm. The insulating sheet 26 thus formed is interposed between the leads 21 and 22, and bonded to the leads 21 and 22 via a bonding layer (not shown) of 50-μm thickness of a BAg-8 brazing material. Typical bonding conditions are 810° C. × 3 minutes in an atmosphere of $N_2$+10% $H_2$, for example.

When a metallized layer is formed on the joint surfaces of the insulating sheet 26 and the leads 21 and 22, a Ti-powder content of less than 1% of the silver solder powder could not positively form uniform metallized layers, while a Ti-powder content of over 10% would produce too thick reaction layers formed in the metallized layers, resulting in lowered bonding strength.

When the leads 21 and 22, and the insulating sheet 26 bonded in the above-mentioned manner were tested for bond properties and air-tightness following the same procedures as with the abovementioned embodiment, excellent results were obtained.

Figure 8:
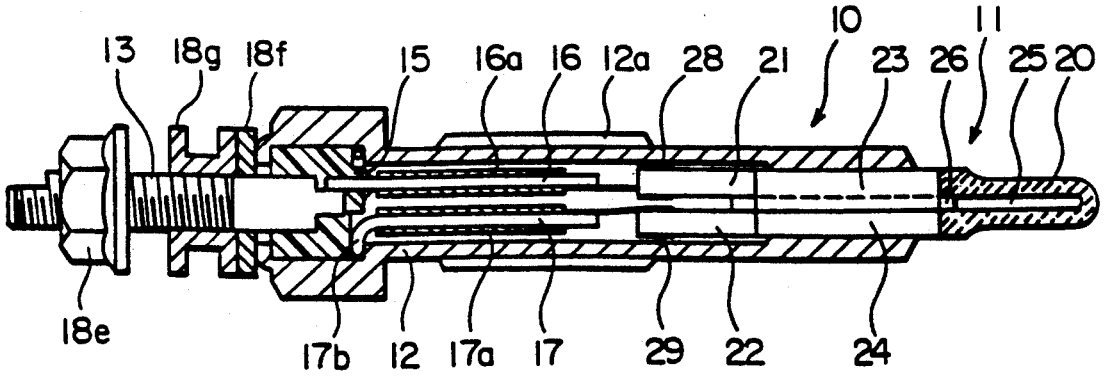
FIG. 8 is a longitudinal section illustrating still another embodiment of this invention.

Next, the bonding material for bonding the leads 21 and 22 to the electrodes 28 and 29 of the ceramic heater 11 shown in FIG. 1 will be described. First, a paste is prepared by uniformly mixing three parts by weight of Ti powder (purity: 99%) of under 350-mesh with 97 parts by weight of BAg-8 silver solder powder (72% Ag + 28% Cu) of under 400-mesh, and adding to the mixture a binder consisting of 10% ethyl cellulose + 90% diethylene glycol monoethyl ether. The paste thus formed is applied to the surfaces of the electrode take-off ends of the leads 21 and 22 by brushing or screen printing to a thickness of 120 μm, and heat-treated, with electrodes 28 and 29 fitted, in a vacuum of $2\times10^{-5}$ Torr at 820° C. for three minutes. With this treatment, Ti in the paste reacts with ceramics to bond the electrodes 28 and 29 to the electrode take-off ends. A Ti-powder content to less than 1% of the silver solder powder could not positively form uniform metallized layers, while a Ti-powder content of over 10% would produce too thick reaction layers formed in the metallized layers, resulting in lowered bonding strength FIG. 8 is a longitudinal section illustrating still another embodiment of this invention. Like parts are indicated by like numerals in FIG. 1 above. In the figure, a metallic lead wire 16 connected to one lead 21 is connected to an external connection terminal 13, and an end 17*b* of another metallic lead wire 17 connected to the other lead 22 is electrically connected to a holder 12 to constitute a so-called body-earth. Numeral 18*f* denotes an insulating ring; and 18*g* denotes a nut for fixing the ring 18*f*. Other components are the same as shown in FIG. 1. Consequently, the same effects can be expected as with the other embodiments mentioned above.

In this embodiment, Ti powder is used as a reactive metal powder to be added to the bonding material. In place of Ti, however, the powder of Zr, Hf, $TiH_2$ or any other reactive metal or its hidrogenate may be used.

This invention is not limited to the constructions of the abovementioned embodiments. The shape, construction, etc. of each component may be freely changed. The shape of the ceramic heater, for example, is not limited to the shape of a round rod as in the above embodiments, and may be of a square rod shape having a rectangular cross-section or of an elliptic cylinder shape having an oblong cross-section.

The above-mentioned embodiments have such a construction that an insulating layer consisting of glass or other insulating materials is formed on the almost entire outer periphery of the leads to bond and fixedly fit the ceramic heater in a cantilevered state to the tip of the holder, and a metallic lead wire is bonded to each lead. The construction of this invention may be such that a metallized layer is formed on the outer periphery of one lead, and an insulating layer is formed on the outer periphery of the other lead and bonded to the holder.

Having the above-mentioned construction, the glow plug for diesel engines of this invention has the following beneficial effects.

(1) Despite its simple construction, the glow plug having a heating portion exposed on the outside surface of the heater can red-heat the tip thereof more rapidly and positively than the conventional type, and can give full play to the quick-heating function thereof.

(2) Since the electrically conductive ceramics for forming the heating portion and the leads are made of the same material, virtually no cracking and other accidents are caused by sharp temperature rise during the heating of the heater, thus ensuring reliability, such as heat resistance.

(3) The electrically conductive ceramics is excellent in heat resistance, facilitating after glowing for long hours as measures for controlling exhaust gas and noise for the diesel engine.

(4) Having a simple overall construction, the forming, machining and assembly of the glow plug is easy, leading to improved productivity.

(5) The use of a metallic brazing material ensures perfect bonding of ceramic components, leading to substantially improved air-tightness and reliability.

(6) The bonding strength between the leads and the electrode to be connected to metallic lead wires is high, leading to substantially improved reliability.

What is claimed is:

1. A glow plug for diesel engines comprising a ceramic heater supported, with one end thereof cantilevered toward the outside of a hollow holder; said ceramic heater is composed of a U-shaped heating portion and a pair of leads extending backwards from both ends of said U-shaped heating portion, both leads being formed integrally of an electrically conductive sialon the outer periphery of at least one of said leads is bonded and held in said holder by an insulating layer; the rear end of at least one of said leads is connected to an electrode connected to a metallic lead wire via a bonding material; an insulating sheet formed of an insulating ceramic material is inserted into a slit formed between said leads and said leads and said insulating sheet are integrally bonded via a bonding material containing 6–10% wt. % titanium, with the balance being any one or both of copper and silver and including foil, paste and coating materials forming a reaction layer having a thickness of 1–20 μm, whereby air-tightness is improved between said leads and said insulating sheet.

2. A glow plug for diesel engines comprising a ceramic heater supported with one end thereof cantilevered toward the outside of a hollow holder; said ceramic heater is composed of a U-shaped heating portion and a pair of leads extending backward from both ends of said U-shaped heating portion, both being formed integrally by an electrically conductive sialon; the outer periphery of at least one of said leads is bonded and held in said holder via an insulating layer; the rear end of at least one of said leads is connected by means of a metallic lead wire via a bonding material to an external connection terminal; and said ceramic heater and other components are integrally bonded by forming metallized layers via said bonding material to form reaction layers, said bonding material including 6–10 wt. % titanium, with the balance being one or both of silver solder copper forming an improved air-tight seal between said leads and said insulating sheet.

3. A glow plug in accordance with claim 2, wherein: said bonding material is a paste made of powder and a binder, said binder being made of substantially 10% ethyl cellulose and 90% diethylene glycol monoethyl ether.

4. A glow plug in accordance with claim 2, wherein: said bonding material is an alloy foil and said integral bonds between said ceramic heater and said other components being formed by heating said bonding material in a vacuum.

5. A glow plug in accordance with claim 2, wherein: said bonding material is originally a combination of a titanium foil and a copper foil.

6. A glow plug in accordance with claim 2, wherein: said bonding material is originally a combination of a titanium-copper alloy foil and a titanium foil.

7. A glow plug for diesel engines as claimed in claim 5 wherein the thickness of said reaction layers is 1–20 μm.

8. A glow plug for diesel engines as claimed in claim 2 wherein an insulating sheet comprising an insulating ceramic material is inserted into a slit formed between said leads, and said leads and said insulating sheet are integrally bonded.

9. A glow plug for diesel engines as claimed in claim 2 wherein the rear ends of said leads are integrally bonded to electrodes connected to metallic lead wires.

10. A glow plug in accordance with claim 2, wherein:

said bonding material is originally a powder of a titanium-copper alloy.

11. A glow plug in accordance with claim 11, wherein:

said powder of a titanium-copper alloy is under 350-mesh.

12. A glow plug in accordance with claim 2, wherein:

said titanium is originally in a substantially pure powder form and said integral bonds between the said ceramic heater and said other components being formed by heating said bonding material in a vacuum.

13. A glow plug in accordance with claim 12, wherein:

said titanium powder is under 350-mesh.

14. A glow plug in accordance with claim 12, wherein:

said balance is originally a mixture of silver powder and copper powder.

15. A glow plug in accordance with claim 14, wherein:

said silver powder and said copper powder is under 350-mesh.

16. A glow plug in accordance with claim 12, wherein:

said balance is originally a powder of a silver-copper alloy.

17. A glow plug in accordance with claim 14, wherein:

said powder of said silver-copper alloy is under 350-mesh.

18. A glow plug for diesel engines, comprising:

a hollow holder including electrical leads and support surfaces;

a ceramic heater formed of an electrically conductive sialon ceramic material to provide a U-shaped heating portion and ceramic material leads extending from said U-shaped heating portion; and, a bond integrally joining said ceramic heater to one of said electrodes and supporting surfaces, said bond formed by a bonding material containing 3–10 wt % substantially pure titanium powder, with the balance being one or more of copper and silver for forming a bond with an improved air-tight seal.

* * * * *

UNITED STATES PATENT AND TRADEMARK OFFICE

CERTIFICATE OF CORRECTION

PATENT NO. : 5,189,280

DATED : February23, 1993

INVENTOR(S) : Okazaki et al

It is certified that error appears in the above-identified patent and that said Letters Patent is hereby corrected as shown below:

On the title page of the Patent, please correct the Assignee data as follows:

[73] Assignees: Hitachi Metals, Ltd.: Jidosha Kiki Co., Ltd., both of Tokyo, Japan Signed and Sealed this Twenty-eighth Day of December, 1993

*Attest:*

Bruce Lehman

BRUCE LEHMAN

*Attesting Officer*

*Commissioner of Patents and Trademarks*